US012012262B2

(12) United States Patent
Zirollo

(10) Patent No.: US 12,012,262 B2
(45) Date of Patent: Jun. 18, 2024

(54) CHILD-PROOF PAPER OR CARDBOARD CONTAINER

(71) Applicant: Fameccanica.Data S.p.A., San Giovanni Teatino (IT)

(72) Inventor: Angelo Zirollo, San Giovanni Teatino (IT)

(73) Assignee: Fameccanica.Data S.p.A., San Giovanni Teatino Chieti (IT)

( * ) Notice: Subject to any disclaimer, the term of this patent is extended or adjusted under 35 U.S.C. 154(b) by 0 days.

(21) Appl. No.: 17/712,492

(22) Filed: Apr. 4, 2022

(65) Prior Publication Data

US 2022/0315297 A1 Oct. 6, 2022

(30) Foreign Application Priority Data

Apr. 6, 2021 (EP) ..... 21166876

(51) Int. Cl.

| | |
|---|---|
| ***B65D 50/04*** | (2006.01) |
| ***B65D 5/02*** | (2006.01) |
| ***B65D 5/28*** | (2006.01) |
| ***B65D 5/66*** | (2006.01) |

(52) U.S. Cl.

CPC ..... *B65D 50/046* (2013.01); *B65D 5/0227* (2013.01); *B65D 5/28* (2013.01); *B65D 5/6652* (2013.01); *B65D 2215/02* (2013.01)

(58) Field of Classification Search

CPC ..... B65D 5/38; B65D 5/36; B65D 2215/02; B65D 2215/04; B65D 2203/12; B65D 9/08

USPC ..... 229/125.125, 125.12, 125.26, 125.28, 229/125.19, 148, 149; 206/273, 1.5; 220/345.4

See application file for complete search history.

(56) References Cited

U.S. PATENT DOCUMENTS 2,251,283 A * 8/1941 Johnson ..... B65D 75/5888 229/210
2,331,754 A * 10/1943 Wohlers ..... B65D 5/6608 229/160
2,474,523 A * 6/1949 Reynolds ..... B65D 5/542 229/920
2,745,589 A * 5/1956 Daly ..... B65D 5/685 229/125.26
2,777,630 A * 1/1957 Moberger ..... B65D 43/0222 229/125.28
2,970,742 A * 2/1961 Fleisig ..... B65D 5/685 229/921

(Continued)

FOREIGN PATENT DOCUMENTS

EP 3587293 A1 1/2020
EP 3778411 A1 2/2021

OTHER PUBLICATIONS

European Search Report dated Sep. 10, 2021. 7 pages.

*Primary Examiner* — Steven A. Reynolds
*Assistant Examiner* — Prince Pal
(74) *Attorney, Agent, or Firm* — RMCK Law Group PLC

(57) ABSTRACT

A container for detergent pods includes a container body and a movable cover, wherein the movable cover has a pair of engagement tabs which, in a closed configuration, engage respective windows to form child-proof engagement formations. The container body and the movable cover are entirely made of paper or cardboard and can be recycled as a paper waste without the need of removing any plastic part.

9 Claims, 14 Drawing Sheets

(56) References Cited

U.S. PATENT DOCUMENTS 3,366,496 A * 1/1968 Bomar ..... B65D 5/4295 426/410
3,512,699 A * 5/1970 Wilson ..... B65D 5/0227 229/102
3,533,547 A * 10/1970 Houston ..... B65D 5/22 229/172
3,899,121 A * 8/1975 Herbetko ..... B65D 5/22 229/179
4,053,100 A * 10/1977 Baptist ..... B65D 5/685 229/125.26
4,083,455 A * 4/1978 Keating, Jr. ..... B65D 5/5405 229/226
4,196,843 A * 4/1980 Garmon ..... B65D 5/685 229/165
4,304,355 A * 12/1981 Sykora ..... B65D 5/68 229/125.26
4,717,070 A * 1/1988 Taub ..... B65D 5/685 229/117.16
4,892,247 A * 1/1990 Dirksing ..... B65D 15/22 229/125.32
5,040,722 A * 8/1991 Fromion ..... B65D 5/6667 229/148
5,050,794 A * 9/1991 Wischusen, III ..... B65D 5/248 229/179
5,103,972 A * 4/1992 Ackeret ..... B42F 7/14 229/120.08
5,161,734 A * 11/1992 Ruehl ..... B65D 5/5415 229/223
5,299,732 A * 4/1994 Armor ..... B65D 5/46024 229/117.22
5,518,172 A * 5/1996 Nanno ..... B65D 5/0272 229/148
5,628,533 A * 5/1997 Hill ..... E05C 19/06 292/DIG. 38
5,725,144 A * 3/1998 Stone ..... B65D 5/6608 229/101
6,138,904 A * 10/2000 Baird ..... B65D 5/0075 229/199
6,296,175 B1 * 10/2001 Dixon ..... B65D 5/685 229/102
6,484,931 B1 * 11/2002 Hofte ..... B65D 5/6608 229/149
6,604,676 B2 * 8/2003 Giblin ..... B65D 5/543 229/148
6,672,474 B2 * 1/2004 May ..... A47K 10/46 221/102
6,708,874 B1 * 3/2004 Montgomery ..... B65D 5/4608 206/815
6,749,108 B2 * 6/2004 Naughton ..... B65D 5/005 229/199
7,377,385 B2 * 5/2008 Giannini ..... B65D 5/38 229/125.125
7,473,215 B2 * 1/2009 Moen ..... B65D 5/323 493/128
7,726,552 B2 * 6/2010 Chadima ..... B65D 5/685 232/1 D
7,841,512 B2 * 11/2010 Westerman ..... B65D 5/6697 229/149
8,746,444 B2 * 6/2014 Dehlin ..... B65D 5/38 220/345.4
8,997,979 B2 * 4/2015 Ghini ..... B65D 5/38 206/267
9,783,335 B2 * 10/2017 Everett ..... B65D 5/38
10,494,138 B1 * 12/2019 Velliquette ..... B65D 5/446
11,046,476 B2 * 6/2021 Whitehurst ..... B65D 79/00
2003/0222130 A1 * 12/2003 Fukushima ..... B65D 5/4291 229/149
2005/0017061 A1 * 1/2005 Quaintance ..... B65D 5/685 229/177
2006/0118451 A1 * 6/2006 Edwards ..... B65D 75/42 206/525.1
2008/0054059 A1 * 3/2008 Chadima ..... B65D 5/685 229/102
2009/0152134 A1 * 6/2009 Katsis ..... B65D 5/38 206/96
2013/0193197 A1 * 8/2013 Low ..... B65D 5/308 229/146
2013/0256391 A1 * 10/2013 Jolley ..... B65D 5/36 229/103.2
2015/0197386 A1 * 7/2015 Chang ..... B65D 5/64 206/514
2017/0001752 A1 * 1/2017 Ishikawa ..... B65D 5/64
2017/0008664 A1 * 1/2017 Parkes ..... B65D 5/6667
2017/0036808 A1 * 2/2017 Everett ..... B65D 5/6664
2018/0257827 A1 * 9/2018 Drosos ..... B65D 50/066
2019/0135503 A1 * 5/2019 De Wilde ..... B65D 50/046
2019/0291917 A1 * 9/2019 Curcic ..... B65C 3/18
2020/0180808 A1 * 6/2020 Gauvin ..... B65D 5/38
2020/0189813 A1 * 6/2020 Drosos ..... B65D 83/0463
2021/0016939 A1 * 1/2021 Palmer ..... B65D 5/38
2021/0047072 A1 * 2/2021 Ng Pak Leung .... B65D 5/4608
2021/0171235 A1 * 6/2021 Boland ..... B65D 5/38
2021/0269191 A1 * 9/2021 Peterson ..... B65D 5/0209
2021/0292056 A1 * 9/2021 Tidwell ..... A24F 23/00
2021/0347524 A1 * 11/2021 Hoefte ..... B65D 5/685
2022/0081155 A1 * 3/2022 Hoefte ..... B65D 5/443
2022/0144507 A1 * 5/2022 Ubell ..... B65D 50/046
2022/0169426 A1 * 6/2022 Drosos ..... B65D 50/066
2022/0289436 A1 * 9/2022 Hoefte ..... B65D 13/04
2022/0332460 A1 * 10/2022 Bressan ..... B65D 5/38
2022/0380097 A1 * 12/2022 Li ..... B65D 50/066
2023/0015201 A1 * 1/2023 Arango ..... B65D 5/4266
2023/0113321 A1 * 4/2023 Bressan ..... B65D 5/665 206/1.5
2023/0142224 A1 * 5/2023 Buck ..... B65D 5/38 53/492
2023/0249870 A1 * 8/2023 Huang ..... B65D 5/38 229/125.125
2023/0264852 A1 * 8/2023 Hoefte ..... B65D 5/6608 206/1.5
2023/0264853 A1 * 8/2023 Hoefte ..... B65D 5/566 229/125.26
2023/0286695 A1 * 9/2023 Hoefte ..... B65D 5/6608

* cited by examiner

CHILD-PROOF PAPER OR CARDBOARD CONTAINER

CROSS-REFERENCE TO RELATED APPLICATION

This application claims priority to European Patent Application No, 21166876.9 filed Apr. 6, 2021. The disclosure of the above application is incorporated herein by reference in its entirety.

FIELD OF THE INVENTION

The present invention relates to containers, in particular to containers for household products.

The invention was developed in view of its application to containers for laundry and dishwasher detergent pods.

PRIOR ART

Laundry and dishwasher detergent pods are water-soluble pouches containing highly concentrated laundry detergents, softeners, and other laundry products. Detergent pods are becoming increasingly popular in view of the ease of use for the user and the positive impact on sustainability as they are a way to reduce wasted use of powdered and liquid detergent by having precise measurements for a load.

Concern has been raised over children accidentally being exposed to laundry pods, because of their pattern and multi-color design which make them similar to candies and the risk that children may confuse them as such.

In 2012, in response to a child swallowing Tide Pods, Procter & Gamble said they would make the pod container more difficult to open by adding a double latch to the lid, and has also re-focused their advertising to make clear the product should be out of a child's reach at all times. The pod packaging was also changed to an opaque orange rather than the original clear plastic gumball machine-type presentation to make them look less enticing. Other manufacturers followed suit with equivalent packaging changes. In 2013, *Consumer Reports* stated that there had been nearly 7,700 reported incidents in which children aged 5 or younger had been exposed to laundry pods, and that year one child from Florida died after ingesting a pod. In 2014, a study published in *Pediatrics* found that from 2012 to 2013, more than 17,000 calls were made to poison control centers about children who had been exposed to the pods. Despite the industry's move toward safer packaging, a 2017 study published in *JAMA Ophthalmology* found that between 2012 and 2015, the number of chemical eye burns associated with laundry detergent pods among 3- to 4-year-old children skyrocketed from fewer than 20 to almost 500 per year. In 2015, these injuries were responsible for 26% of all chemical eye burns among this population.

In light of the dangers posed by the ingestion of pods by children, packaging manufacturers have committed to the development of child-resistant containers, the introduction of which has reduced the incidence of accidental ingestion of potentially hazardous substances by children under the age of 5. Whether this is due to the use of this type of packaging is not easily assessed, but there is no doubt that child-resistant packaging has made a positive contribution to this reduction. Given the increasingly frequent use of this type of packaging, it has become necessary to define its characteristics and relative testing methods in order to provide adequate guarantees and avoid confusion and misunderstandings in a sector of great importance for the safety of children.

To meet this need, UNI has published the UNI EN ISO 8317:2005 standard "Child-resistant packaging—Requirements and test procedures for reclosable packaging". This standard establishes the characteristics that resealable packaging must have before being placed on the market (in particular for solvents, household hygiene products, strongly acid or alkaline preparations, substances used for gardening, etc.).

Child-resistant containers, when tested in accordance with the standards, must provide a satisfactory degree of resistance to opening by children but—at the same time—a sufficient level of accessibility to its contents by adults.

The test procedures should therefore be carried out in two stages: a test with children and a test with adults. The test with children is carried out in the presence of a supervisor and in an environment that is familiar to them: a group of no more than 200 children between the ages of 42 and 51 months is formed. The children must be selected so as to represent as faithfully as possible the different social, ethnic and cultural origins of the population as a whole, and not only of the area where the test is carried out. Each pair of children is given a number of packages to open by whatever means they wish to use. They have 10 minutes: if they cannot open or access the contents of the product in the first five minutes of the test, they must watch a single demonstration of opening the packaging by an adult; after which they have another five minutes to try to open the packaging.

The packaging is considered compliant if:

- at least 85% of the children have failed to open the packaging within the first five minutes, and
- at least 80% of the children were unable to open the packaging within the next five minutes of seeing the demonstration.

The vast majority of containers for detergent pods presently on the market are made of plastic materials, because of the need to provide the containers with elastic snap-engagement formations and locking elements which are necessary to ensure compliance with child-proof requirements.

One of the key goals nowadays is to achieve sustainable resource use, particularly in packaging solutions. Although plastic containers can be recycled when designed as single-material solutions, in common practice only 80% of that material can actually be recycled.

Furthermore, the global average recycling rate for plastic in 2019 was only 8%, making plastic an undesirable material from a sustainability perspective. Therefore, the use of plastic should be minimized.

All known solutions, however, fall far short of minimizing the amount of plastic when it comes to providing the functions and features expected from packaging.

Many containers are nowadays made to a greater or lesser extent of paper or cardboard which—as such—represent environmentally sustainable materials with a low environmental impact as they are totally recyclable.

However, the creation of child-proof containers made of paper or cardboard for detergent pods is a challenge, as it is difficult to make re-closable child-proof containers made of paper or cardboard that meet the requirements of child-resistant standards.

OBJECT AND SUMMARY OF THE INVENTION

The object of the present invention is to provide an eco-sustainable container for detergent pods which overcomes the problems of the prior art.

More specifically the object of the present invention is to provide a child-proof re-closable container made of paper or cardboard.

In accordance with the present invention, these objects are achieved by a container according to claim 1.

According to another aspect, the invention relates to paper or cardboard blanks for manufacturing child-proof containers.

The claims form an integral part of the technical disclosure provided here in relation to the invention.

BRIEF DESCRIPTION OF THE DRAWINGS

The present invention will now be described in detail with reference to the attached drawings, given purely by way of non-limiting example, wherein.

It should be appreciated that the attached drawings are schematic and various figures may not be represented in the same scale. Also, in various figures some elements may not be shown to better show other elements.

DETAILED DESCRIPTION

Figure 1:
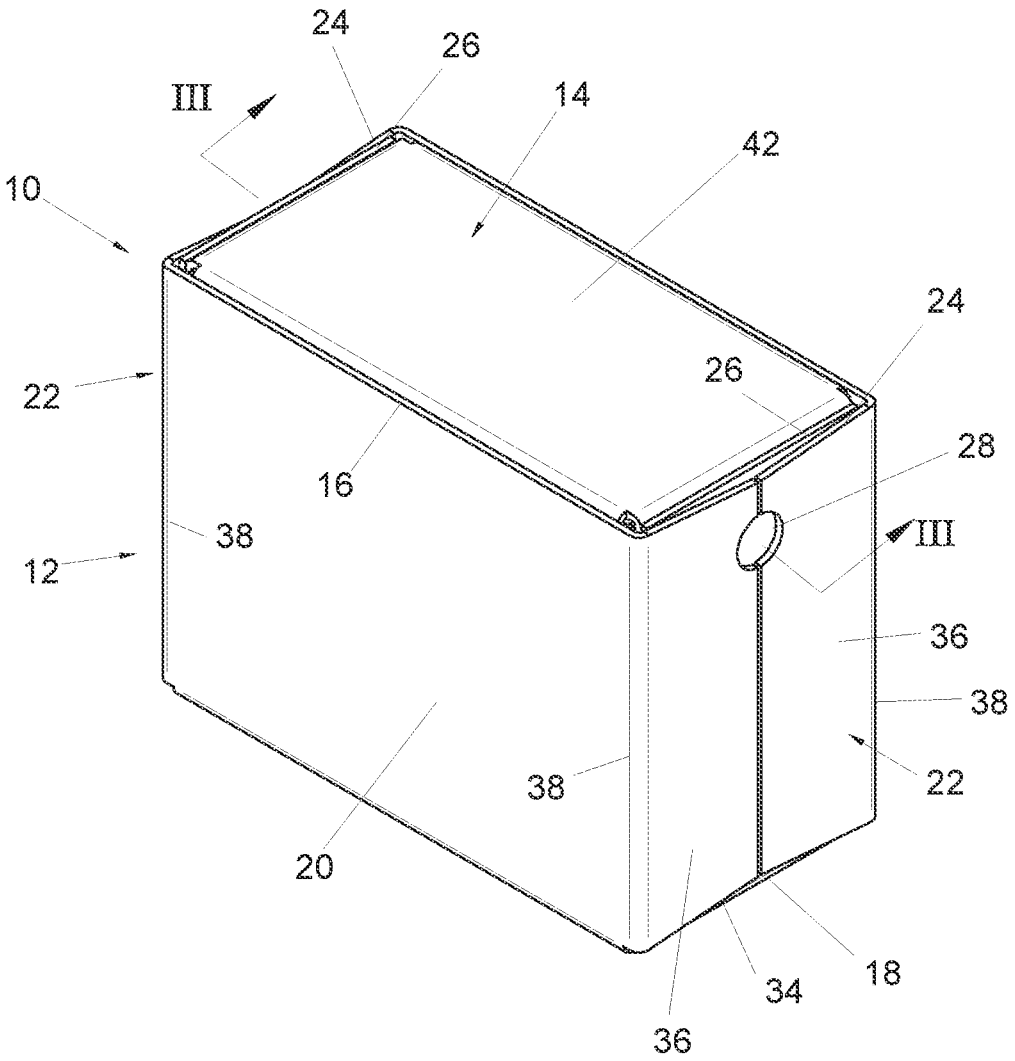
FIG. 1 is a perspective view of a first embodiment of a container according to the present invention in a closed configuration.
Figure 2:
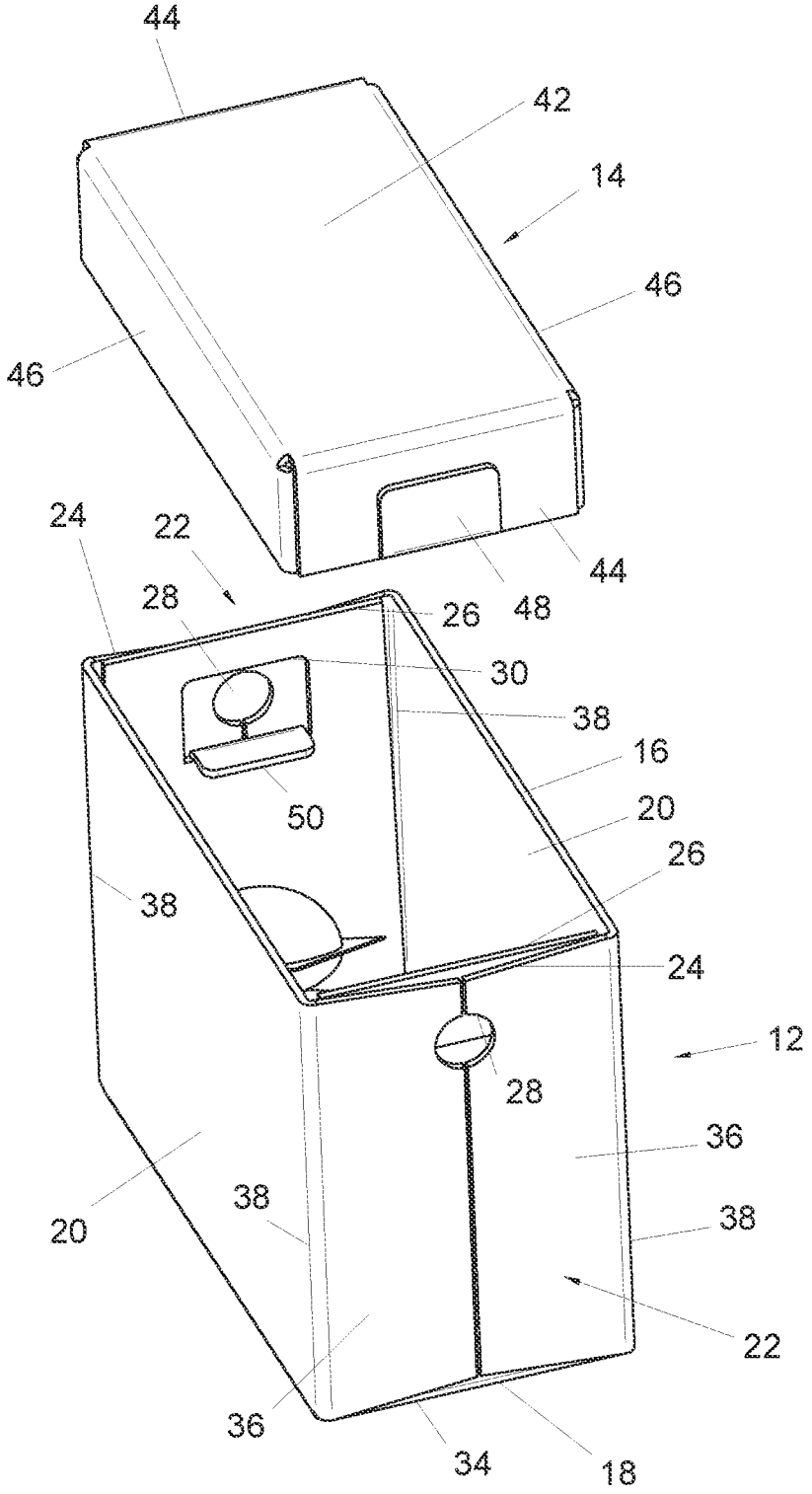
FIG. 2 is a perspective view of the container of FIG. 1 in an open configuration.

With reference to FIGS. 1 and 2, a paper or cardboard container is indicated by the reference numeral 10. The paper or cardboard container 10 comprises a container body 12 and a movable cover 14. The container body 12 has an aperture 16 and the movable cover 14 is removably applied to the aperture 16 and is movable between a closed configuration shown in FIG. 1 and an open configuration shown in FIG. 2.

In the embodiment shown in FIGS. 1-5 the movable cover 14 is detachable from the container body 12.

Figure 4:
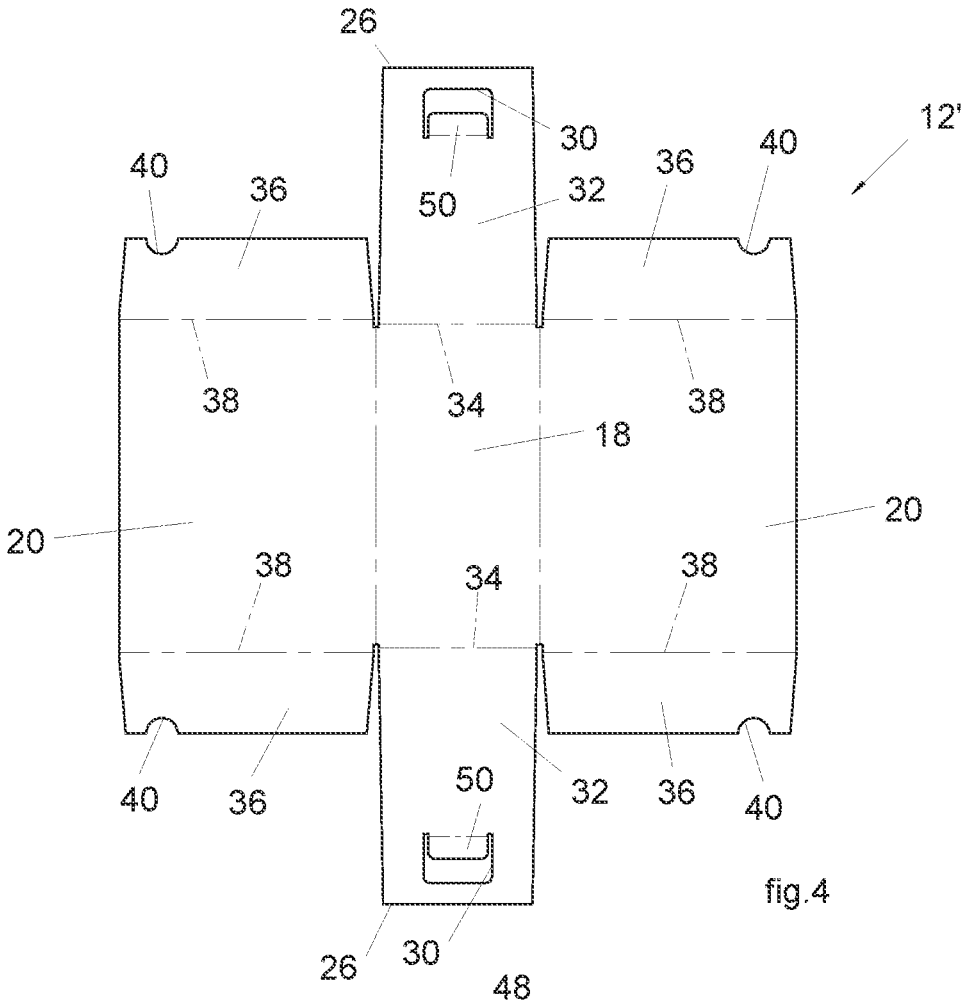
Figure 5:
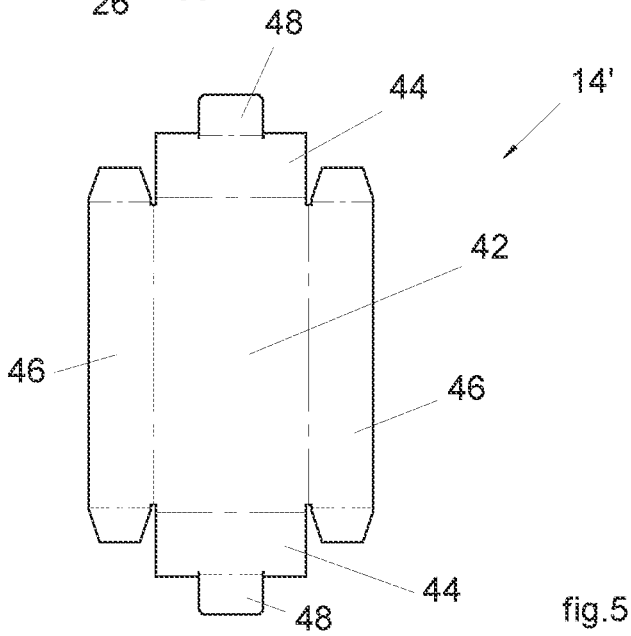
Figure 6:
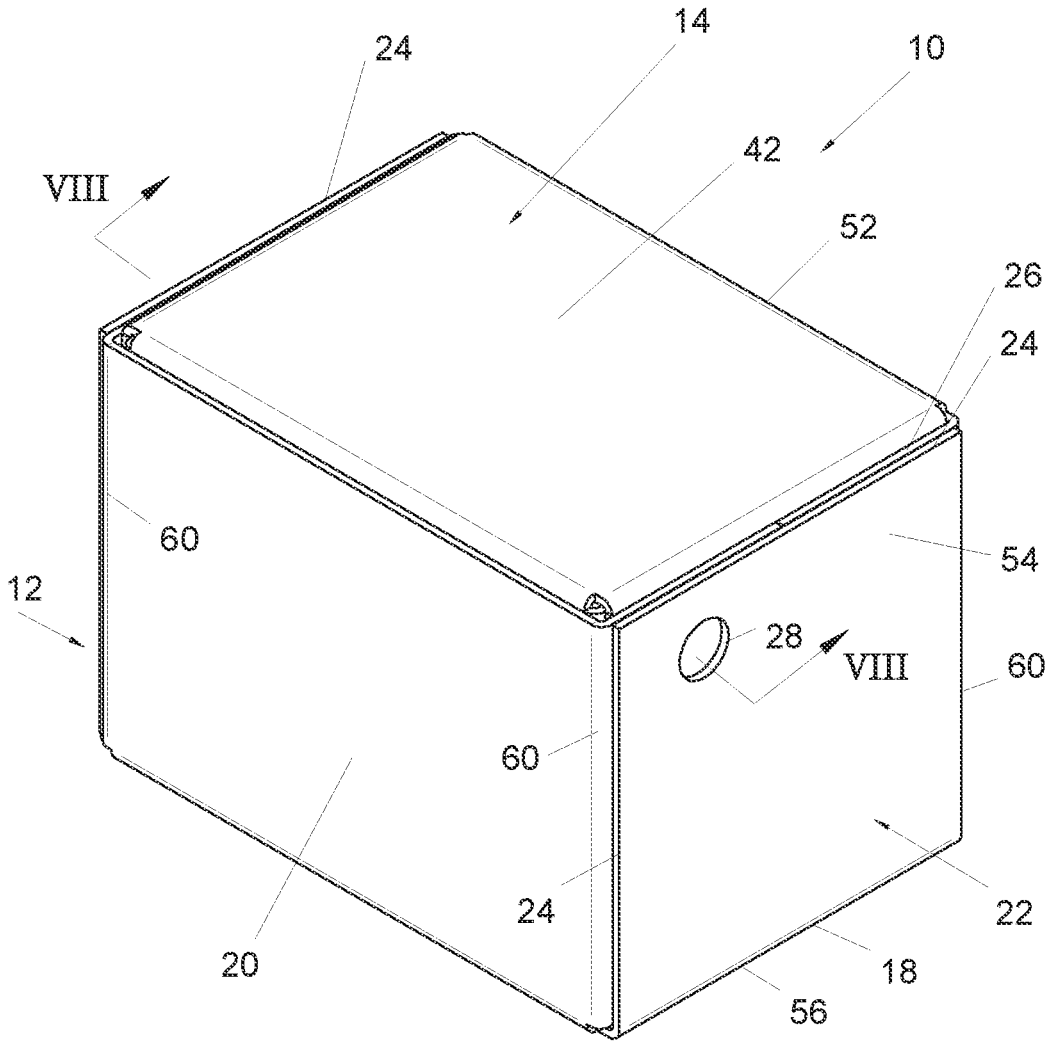
FIG. 6 is a perspective view of a second embodiment of a container according to the present invention in a closed configuration.

The container body 12 and the movable cover 14 are produced starting from respective flat blanks 12', 14' having the shapes shown in FIGS. 4 and 5. The blanks 12', 14' are cut from flat paper or cardboard sheets or from a continuous paper sheet unwound from a reel. The blanks 12', 14' have a plurality of folding lines indicated in FIGS. 4 and 5 by dash and dot lines. The container body 12 and the movable cover 14 are obtained by folding the respective blanks 12', 14' along said folding lines. The container 10 is entirely made of paper or cardboard and can be recycled as a paper waste without the need of removing any plastic part.

The container body 12 comprises a bottom wall 18 opposite the aperture 16, a pair of body front walls 20 parallel to each other and orthogonal to the bottom wall 18, and a pair of body side walls 22 parallel to each other and orthogonal to the bottom wall 18.

Each of the body side walls 22 comprises an outer layer 24 and an inner layer 26 overlapped to each other. The outer layer 24 has a through hole 28 and the inner layer 26 has a through window 30 facing the through hole 28 of the outer layer 24.

With reference to FIG. 4, the inner layer 26 of each of said body side walls 22 may be formed by a first portion 32 connected to the bottom wall 18 of the container body 12 by a first folding line 34. The outer layer 24 of each of said body side walls 22 may be formed by two second portions connected to respective body front walls 20 of the container body 12 by respective second folding lines 38. Each of the two second portions 36 forming the outer layer 24 has one half-hole 40. When the two second portions 36 are coplanar with each other, the two half-holes 40 form the through hole 28.

The two second portions 36 forming the outer layer 24 may be fixed to the respective first portion 32 forming the inner layer 26, e.g. by glue.

With reference to FIG. 2, the movable cover 14 comprises a top wall 42 and a pair of cover sides 44 parallel to each other and orthogonal to the top wall 42. The movable cover 14 may comprise two cover front walls 46 parallel to each other and orthogonal to the top wall 42.

With reference to FIGS. 2 and 5, the movable cover 14 has a pair of engagement tabs 48 projecting from distal sides of the respective cover sides 44. Each engagement tab 48 is folded over an outer surface of the respective cover side 44. The engagement tabs 48 may be fixed, e.g. by glue, to the respective outer surfaces of the cover sides 44 or they may be free, i.e. not fixed to the respective outer surfaces of the cover sides 44.

The engagement tabs 48 and the through windows 30 may be located in central portions of the cover sides 44 and body side walls 22, respectively.

Figure 3:
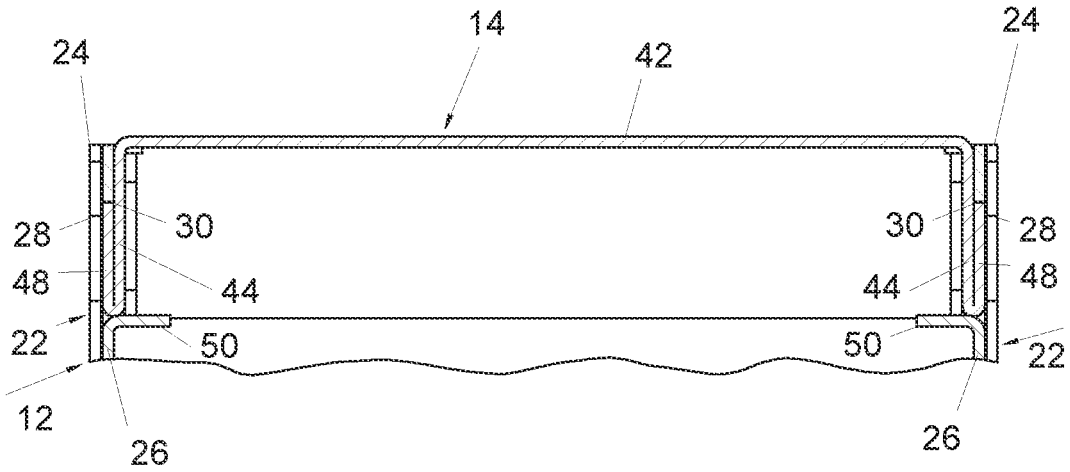
FIG. 3 is a cross-section taken along the line III-III of FIG. 1, FIGS. 4 and 5 are plan view of the paper or cardboard blanks used for manufacturing the container of FIGS. 1 and 2.

With reference to FIGS. 1 and 3, in the closed configuration of the paper or cardboard container 10 the outer surfaces of the cover sides 44 are in contact with respective portions of the inner surfaces of the respective body side walls 22 and the cover front walls 46 are in contact with respective portions of the inner surfaces of the body front walls 20.

With reference to FIG. 3, in the closed configuration the engagement tabs 48 of the cover sides 44 engage into respective windows 30 of the body side walls 22 and retain the cover 14 to the container body 12.

A user may release the cover 14 from the container body 12 by inserting a finger in each of the through holes 28 and pressing inwardly on the engagement tabs 48, so as to disengage the engagement tabs 48 from the respective through windows 30 and simultaneously raising the movable cover 14.

The operations necessary for removing the movable cover 14 are sufficiently complex to ensure that the paper or cardboard container 10 is child-proof compliant.

With reference to FIGS. 2 and 3, in a possible embodiment the inner layer 26 of each of the body side walls 22 has a flap 50 folded orthogonal to the inner layer 26 and extending along a lower edge of the through window 30. The flaps 50 prevent that the cover 14 is pushed into the container body 12 beyond the position in which the engagement tabs 48 are engaged into the respective through windows 30.

A second embodiment of a paper or cardboard container 10 according to the invention is shown in FIGS. 6-9. The elements corresponding to those previously disclosed are indicated by the same reference numerals.

In the embodiment of FIGS. 6-9 the movable cover 14 is hinged to the container body 12. The movable cover 14 and the container body 12 are produced starting from a single paper or cardboard blank 12' having the shape shown in FIG. 9 by folding the blank 12' along folding lines indicated in FIG. 9 by dash and dot lines.

The movable cover 14 is hinged to the container body 12 along a hinge line 52 extending along a side of the top wall 42 of the movable cover 14 and along a top side of one of the front walls 20 of the container body 12.

In the embodiment of FIGS. 6-9 the movable cover 14 has only one cover front wall 46 opposite the hinge line 52. The engagement tabs 48 and the through windows 30 may be located in lateral portions of the cover sides 44 and body side walls 22 which are opposite to the lateral portions of the cover sides 44 and body side walls 22 adjacent to the hinge line 52.

Figure 7:
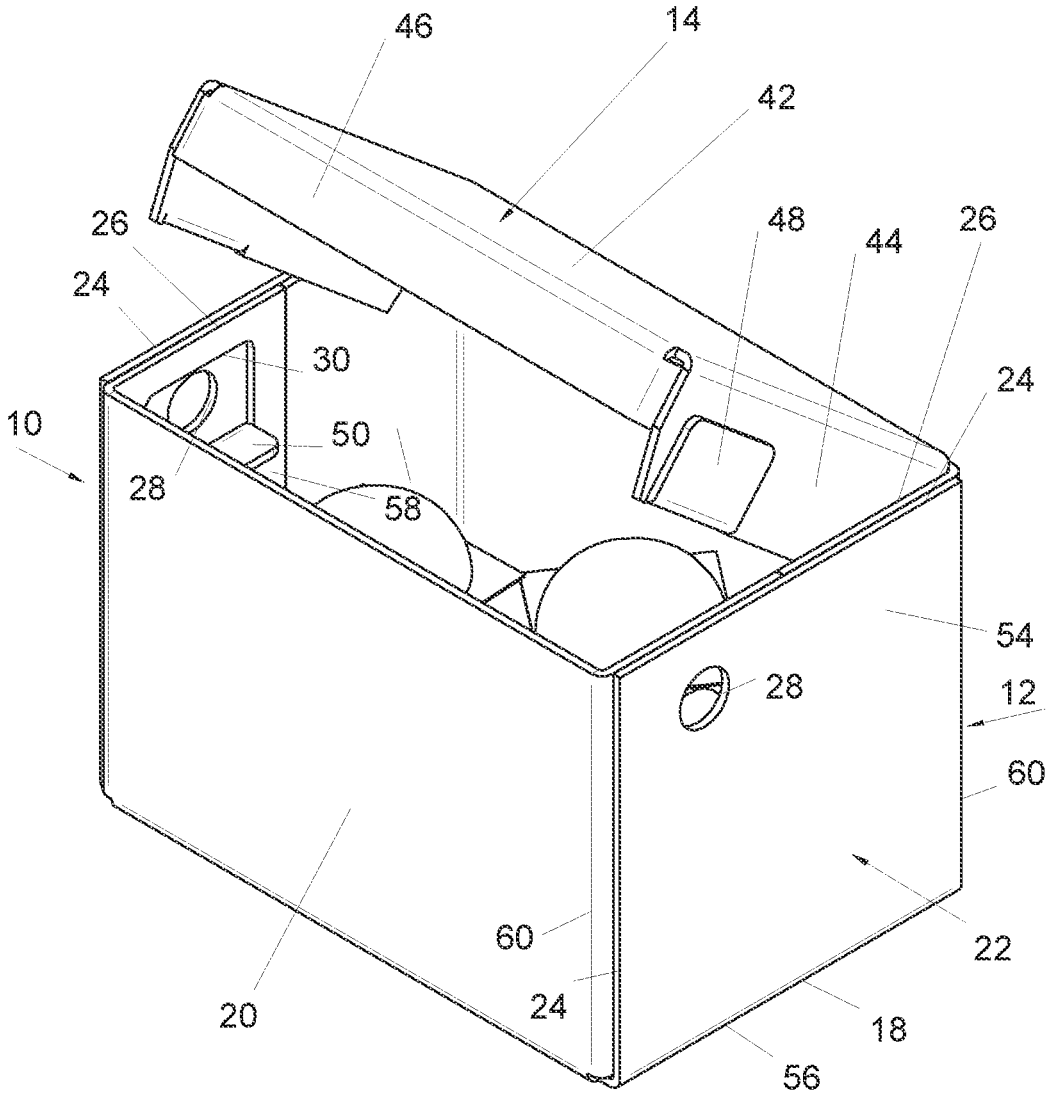
FIG. 7 is a perspective view of the container of FIG. 6 in an open configuration.
Figure 8:
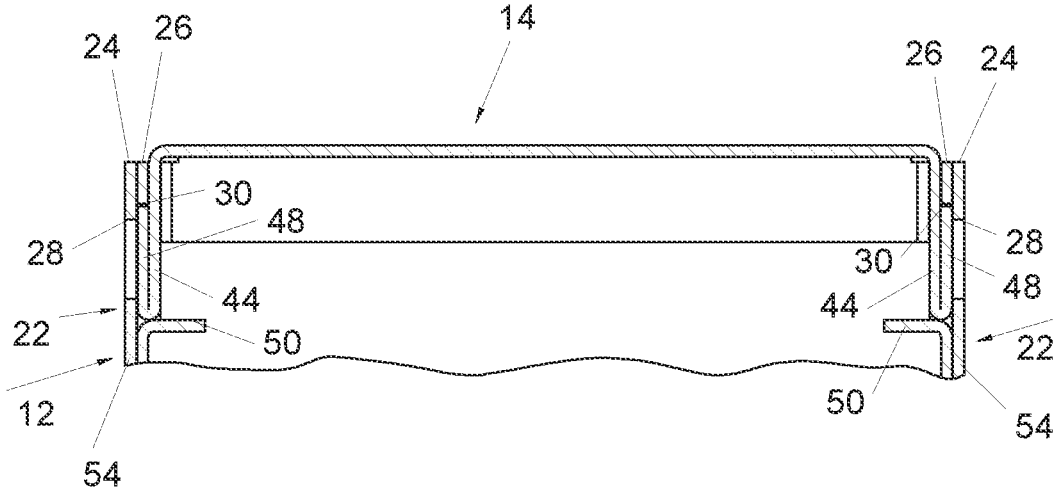
FIG. 8 is a cross-section taken along the line VIII-VIII of FIG. 6.
Figure 9:
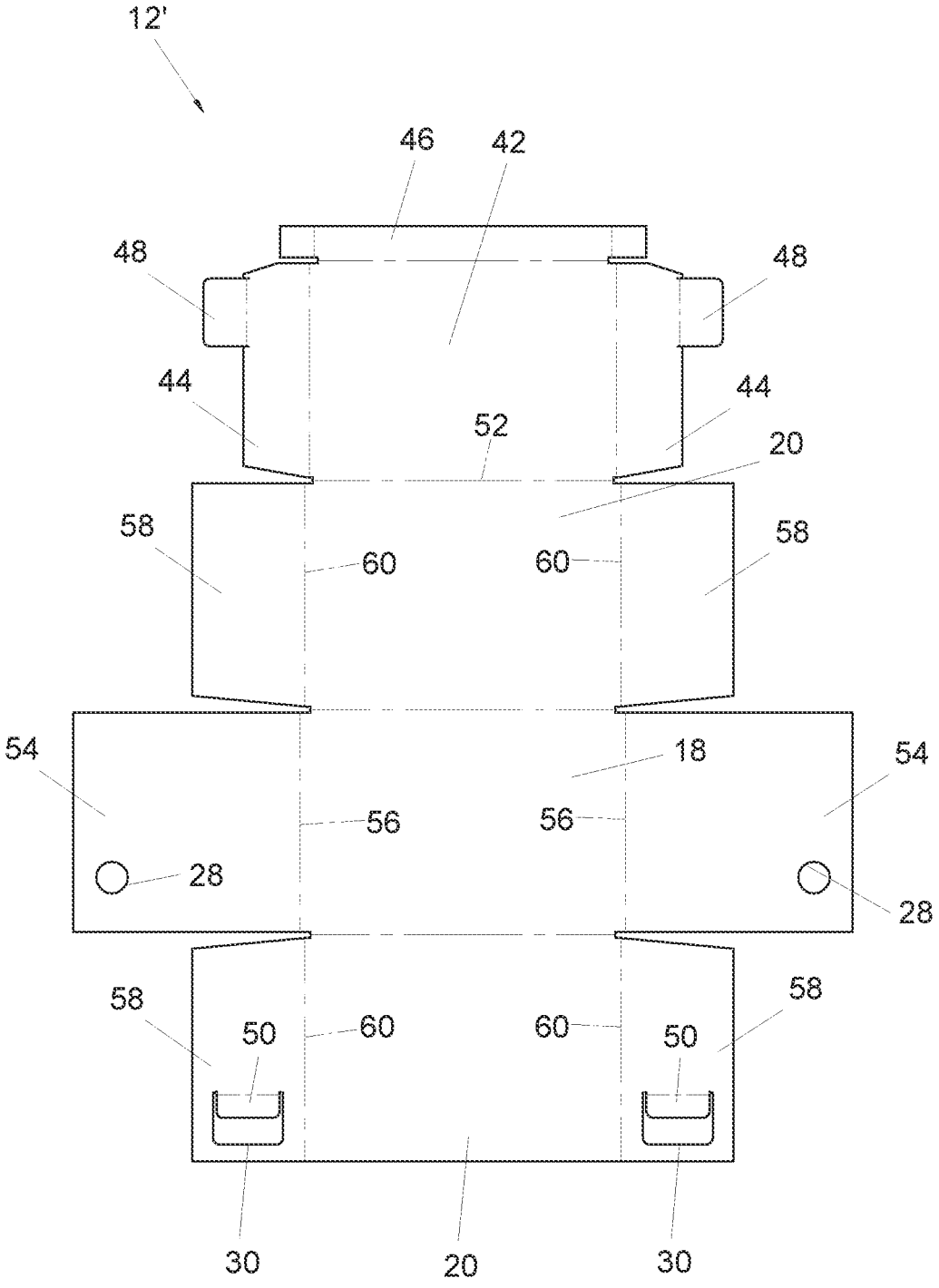
FIG. 9 is a plan view of the paper or cardboard blank used for manufacturing the container of FIGS. 6 and 7.
Figure 10:
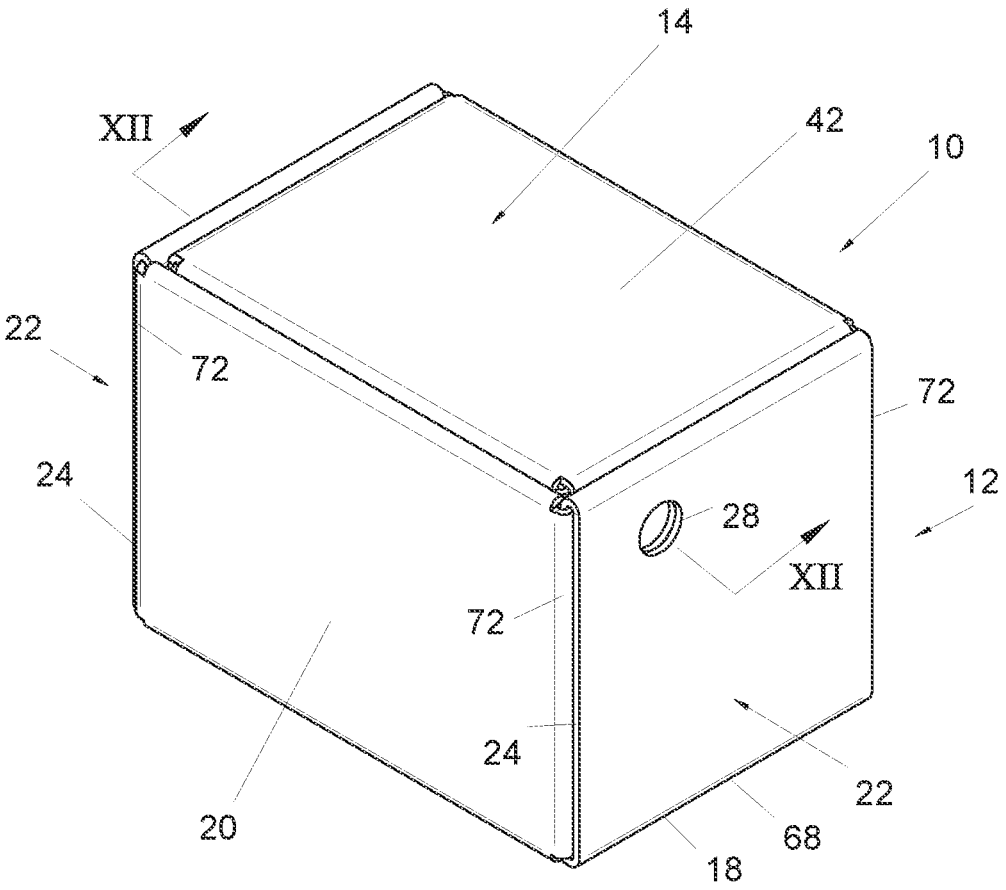
FIG. 10 is a perspective view of a third embodiment of a container according to the present invention in a closed configuration.

With reference to FIGS. 7 and 9, in the embodiment of FIGS. 6-9 the outer layer 24 of each of the body side walls 22 may be formed by a third portion 54 connected to the bottom wall 18 of the container body 12 by a third folding line 56 and the inner layer 26 of each of the body side walls 22 may be formed by two fourth portions 58 connected to respective body front walls 20 of the container body 12 by respective fourth folding lines 60. Also in this embodiment the third portions 54 forming the outer layers 24 may be fixed, e.g. by glue, to the respective fourth portions 58 forming the inner layers 26.

Also in the embodiment of FIGS. 6-9 in the closed configuration the engagement tabs 48 of the cover sides 44 engage into respective windows 30 of the body side walls 22 and retain the cover 14 to the container body 12, and the cover 14 may be released from the container body 12 by inserting a finger in each of the through holes 28 and pressing inwardly on the engagement tabs 48, so as to disengage the engagement tabs 48 from the respective through windows 30 and simultaneously raising the movable cover 14.

A third embodiment of a paper or cardboard container 10 according to the invention is shown in FIGS. 10-13. The elements corresponding to those previously disclosed are indicated by the same reference numerals.

In the third embodiment the movable cover 14 is hinged to the container body 12 as in the second embodiment. Also in this third embodiment the movable cover 14 and the container body 12 are produced starting from a single paper or cardboard blank 12' having the shape shown in FIG. 13 by folding the blank 12' along folding lines indicated in FIG. 13 by dash and dot lines.

Figure 11:
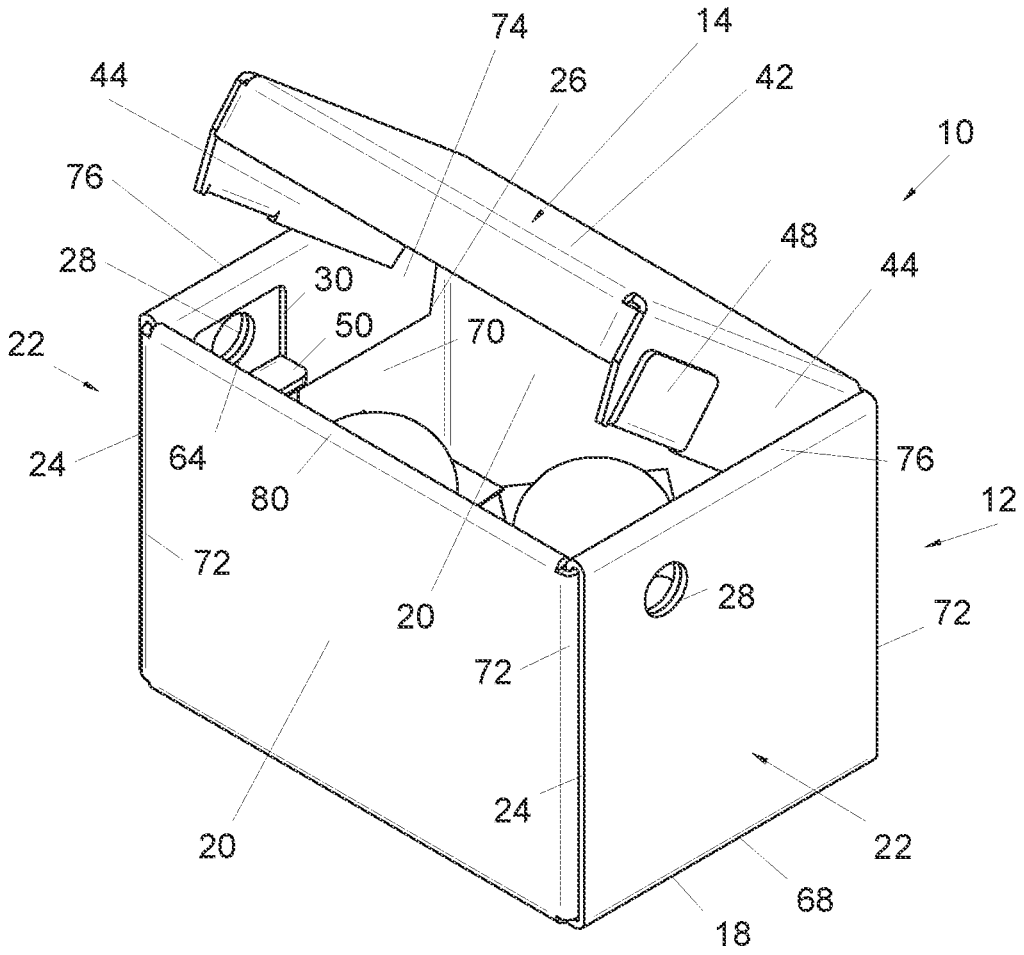
FIG. 11 is a perspective view of the container of FIG. 10 in an open configuration.
Figure 12:
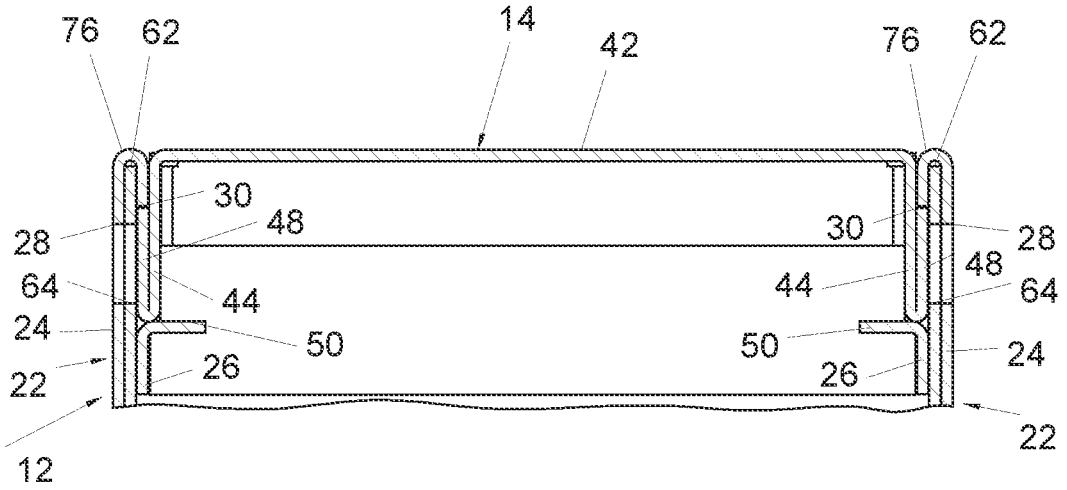
FIG. 12 is a cross-section taken along the line XII-XII of FIG. 10.
Figure 13:
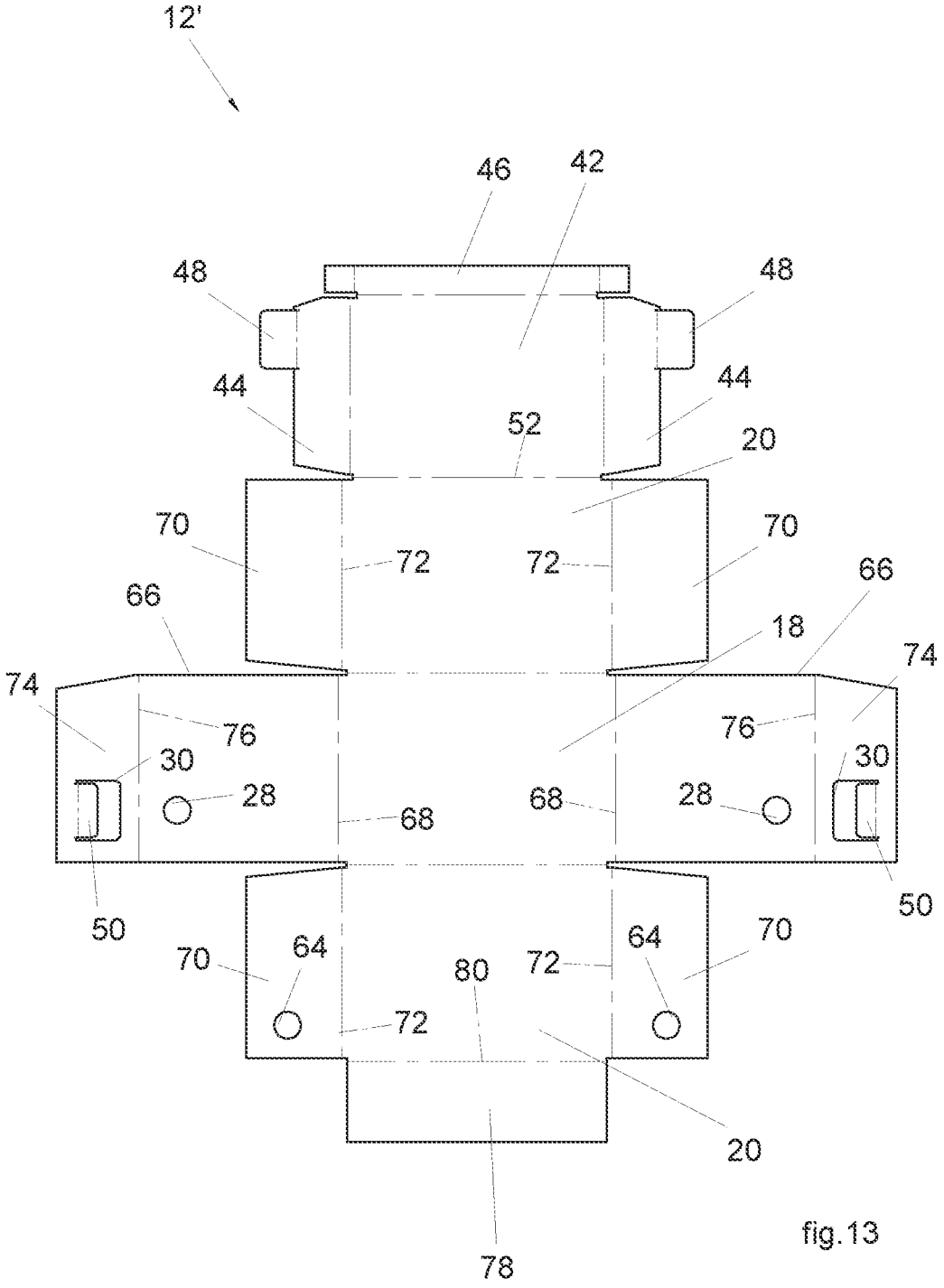
FIG. 13 is a plan view of the paper or cardboard blank used for manufacturing the container of FIGS. 10 and 11.

The third embodiment is designed to improve the resistance to humidity as compared to the second embodiment. With reference to FIGS. 11, 12 and 13, each of the body side walls 22 comprises an intermediate layer 62 set between the inner layer 26 and outer layer 24. The intermediate layer 62 has a second through hole 64 aligned to the through hole 28 of the outer layer 24.

With reference to FIGS. 12 and 13, the outer layer 24 of each of the body side walls 22 is formed by a fifth portion 66 connected to the bottom wall 18 of the container body 12 by a fifth folding line 68.

The intermediate layer 62 is formed by two sixth portions 70 connected to respective body front walls 20 of the container body 12 by respective sixth folding lines 72.

The inner layer 26 is formed by a seventh portion 74 connected to a distal edge of the respective fifth portion 66 by a seventh folding line 76. The through windows 30 and the respective flaps 50 are formed in the respective seventh portions 74.

In the embodiment of FIGS. 10-13 the seventh portions 74 forming the inner layer 26 may extends only on a top part of the respective body side wall 22.

With reference to FIG. 13, the body front wall 20 opposite the hinge line 52 may include an inner layer formed by an eighth portion 78 folded inwardly along an eighth folding line 80. The eighth portion 78 forming the inner layer of the body front wall 20 may extends only on a top part of the respective body front wall 20.

Figure 14:
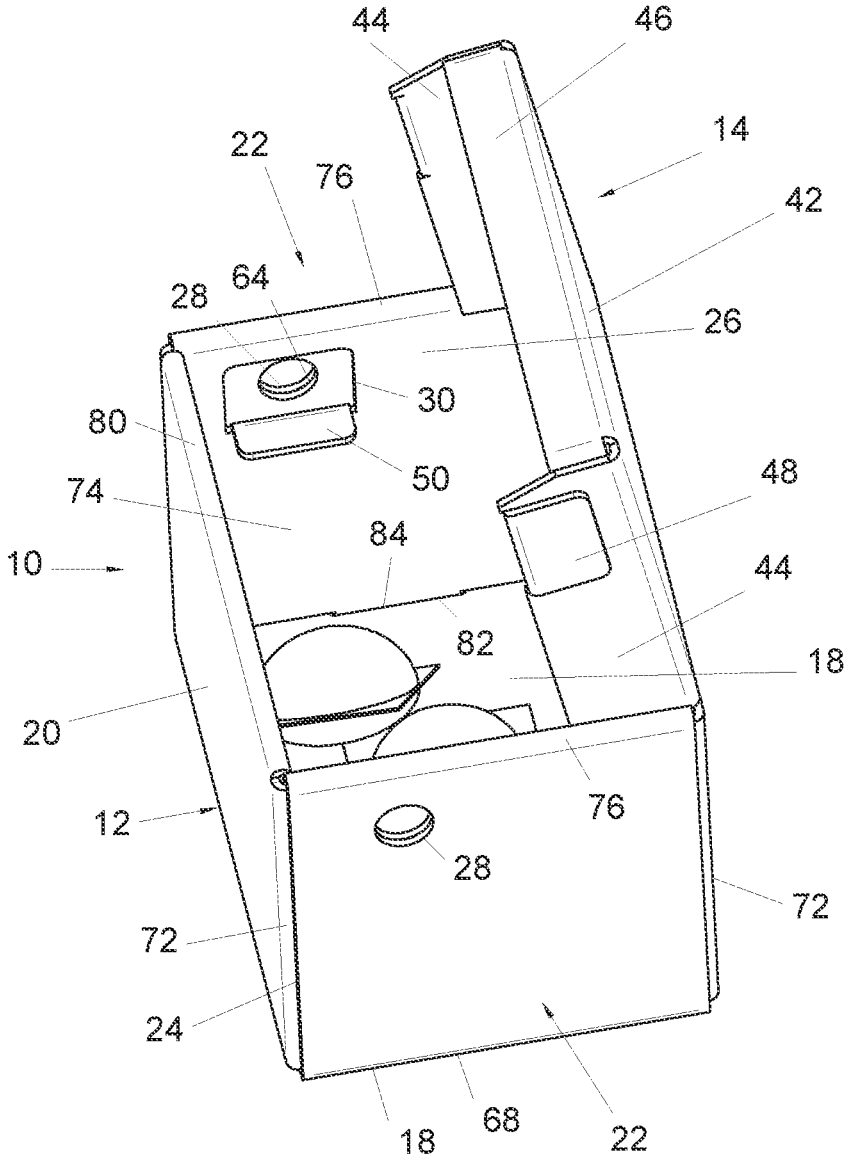
FIG. 14 is a variant of the container of FIG. 11.
Figure 15:
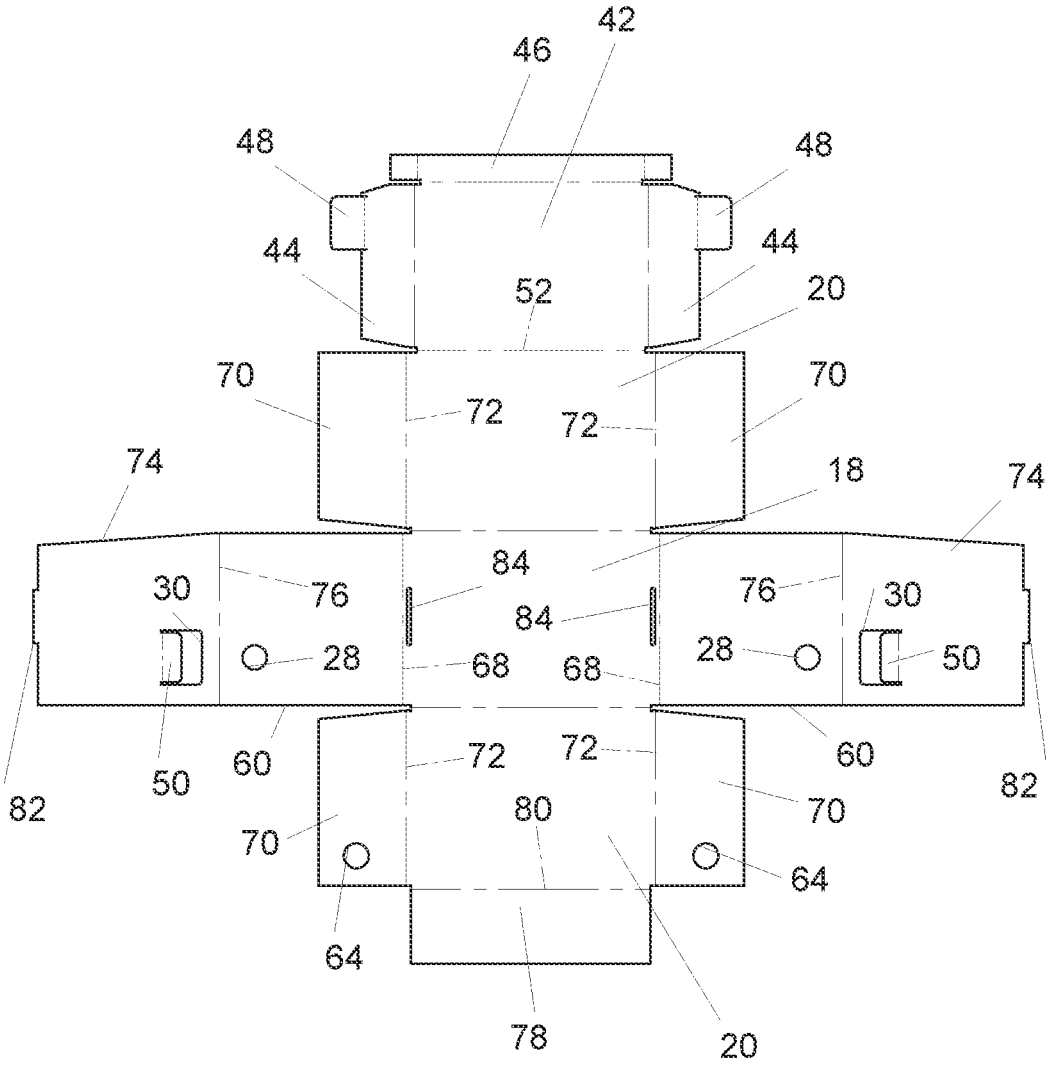
FIG. 15 is a plan view of the paper or cardboard blank used for manufacturing the container of FIG. 14.

FIGS. 14 and 15 show a variant of the embodiment of FIGS. 10-13, wherein the seventh portions 74 forming the inner layers 26 of the body side walls 22 extend on the whole length of the respective body side wall 22. In this case, the seventh portions 74 may have respective notches 82 projecting from respective distal edges and which engage respective slots 84 formed in the bottom wall 18 adjacent to the respective fifth folding lines 68.

Of course, without prejudice to the principle of the invention, the details of construction and the embodiments can be widely varied with respect to those described and illustrated, without thereby departing from the scope of the invention as defined by the claims that follow.

The invention claimed is:

1. A paper or cardboard container, comprising:

a container body having an aperture and a movable cover removably applied to said aperture and movable between an open configuration and a closed configuration, wherein the container body comprises a bottom wall, a pair of body front walls parallel to each other and orthogonal to the bottom wall, and a pair of body side walls parallel to each other and orthogonal to the bottom wall, wherein each of said body side walls comprises an outer layer having a through hole and an inner layer having a through window facing the through hole of the outer layer, wherein the inner layer of each of said body side walls has a flap folded orthogonal to the inner layer and extending along a lower edge of the through window, wherein the movable cover comprises a top wall, and a pair of cover sides parallel to each other and orthogonal to the top wall, wherein each of said cover sides has an engagement tab folded over a respective outer surface of said cover sides, wherein in said closed configuration the outer surfaces of said cover sides are in contact with respective portions of inner surfaces of respective body side walls, and wherein in said closed configuration the engagement tabs of the cover sides engage into respective through windows of said body side walls and retain the movable cover to the container body, wherein said flaps prevent that the cover is pushed into the container body beyond a position in which the engagement tabs are engaged into the respective through windows, and wherein the movable cover is configured to be released from the container body by pressing inwardly on said engagement tabs, which are accessible via said through holes, and wherein the movable cover is hinged to the container body along a hinge line extending along a side of the top wall of the movable cover and along a top side of one of said body front walls.

2. The paper or cardboard container of claim 1, wherein the inner layer of each of said body side walls is formed by a first portion connected to the bottom wall of the container body by a first folding line, and wherein the outer layer of each of said body side walls is formed by two second portions connected to respective body front walls of the container body by respective second folding lines.

3. The paper or cardboard container of claim 1, wherein the outer layer of each of said body side walls is formed by a third portion connected to the bottom wall of the container body by a third folding line, and wherein the inner layer of each of said body side walls is formed by two fourth portions connected to respective body front walls of the container body by respective fourth folding lines.

4. The paper or cardboard container of claim 1, wherein each of said body side walls comprises an intermediate layer set between said inner layer and outer layer, wherein said intermediate layer has a second through hole aligned to said through hole of said outer layer, wherein the outer layer of each of said body side walls is formed by a fifth portion connected to the bottom wall of the container body by a fifth folding line, wherein the intermediate layer is formed by two sixth portions connected to respective body front walls of the container body by respective sixth folding lines, and wherein the inner layer is formed by a seventh portion connected to a distal edge of the respective fifth portion by a seventh folding line.

5. The paper or cardboard container of claim 4, wherein said seventh portion extends on only a top part of the respective body side wall.

6. The paper or cardboard container of claim 4, wherein said seventh portion extends on a whole length of the respective body side wall.

7. The paper or cardboard container of claim 6, wherein each of said seventh portions has a respective notch projecting from a distal edge and engaging a respective slot formed in the bottom wall adjacent to one of the respective fifth folding lines.

8. The paper or cardboard container of claim 1, wherein said engagement tabs and said through windows are located in lateral portions of said cover sides and body side walls opposite to lateral portions of said cover sides and body side walls adjacent to said hinge line.

9. A paper or cardboard blank for producing a paper or cardboard container according to claim 1.

* * * * *